United States Patent [19]

Tokuno et al.

[11] Patent Number: 4,586,673

[45] Date of Patent: May 6, 1986

[54] APPARATUS FOR AUTOMATICALLY MOUNTING A WEB ROLL ON A MILL ROLL STAND

[75] Inventors: Masateru Tokuno, Nishinomiya; Tetsuya Sawada, Kyoto; Yoshihiro Ishii, Yao, all of Japan

[73] Assignee: Rengo Co., Ltd., Osaka, Japan

[21] Appl. No.: 642,719

[22] Filed: Aug. 21, 1984

Related U.S. Application Data

[63] Continuation of Ser. No. 431,086, Sep. 30, 1982, abandoned.

[30] Foreign Application Priority Data

Oct. 5, 1981 [JP] Japan ..... 56-159856
Oct. 21, 1981 [JP] Japan ..... 56-171057

[51] Int. Cl.[4] ..... B65H 19/12
[52] U.S. Cl. ..... 242/58.6
[58] Field of Search ..... 242/57, 58, 58.2, 58.4, 242/58.6, 79, 57.1

[56] References Cited

U.S. PATENT DOCUMENTS

| | | | |
|---|---|---|---|
| 1,828,297 | 10/1931 | Schmidt | 242/58.2 |
| 2,405,637 | 8/1946 | Behrens | 242/58.6 |
| 2,899,145 | 8/1959 | Carr | 242/58.6 |
| 3,099,117 | 7/1963 | Christiansen | 242/58.6 X |
| 3,351,299 | 11/1967 | Fehr | 242/79 |
| 3,424,394 | 1/1969 | Moore | 242/58.6 |
| 3,740,296 | 6/1973 | McDonald | 156/504 |
| 3,743,198 | 7/1973 | Lucas | 242/58.6 |
| 3,767,133 | 10/1973 | Komatsu | 242/79 X |
| 4,131,206 | 12/1978 | Kawada et al. | 242/58.6 X |
| 4,458,851 | 7/1984 | Tokuno et al. | 242/55 |

FOREIGN PATENT DOCUMENTS

| | | | |
|---|---|---|---|
| 551075 | 5/1932 | Fed. Rep. of Germany . | |
| 2543261 | 3/1977 | Fed. Rep. of Germany | 242/58.6 |
| 1021532 | 3/1966 | United Kingdom . | |
| 1081581 | 8/1967 | United Kingdom . | |
| 1514980 | 6/1978 | United Kingdom . | |
| 2067168 | 7/1981 | United Kingdom . | |

*Primary Examiner*—John M. Jillions
*Assistant Examiner*—Joseph J. Hail, III
*Attorney, Agent, or Firm*—Wenderoth, Lind & Ponack

[57] ABSTRACT

An apparatus for automatically mounting rolls of a web material on a mill roll stand first moves a web roll on a roller conveyor then in an axial direction and next in a lateral direction toward roll then automatically supports. The web roll is aligned with the roll supports by moving it vertically or turning the roll supports.

1 Claim, 15 Drawing Figures

APPARATUS FOR AUTOMATICALLY MOUNTING A WEB ROLL ON A MILL ROLL STAND

This application is a continuation of now abandoned Ser. No. 431,086 filed Setp. 30, 1982.

BACKGROUND OF THE INVENTION

The present invention relates to a apparatus for automatically mounting rolls of a web such as paper, steel or plastic film on to and off from a mill roll stand.

In mounting a web roll on a mill roll stand, the roll is carried by a conveyor from a standby position to the roll stand and the roll supports are inserted into the center hole in the web roll. The conveyor and the roll supports are operated by switching push buttons on and off while watching the roll to judge by eye whether or not the roll has been moved to a proper position.

The same is true for a vertical movement of the roll supports and a lateral movement by hand of the roll to the mill roll stand. It is usually checked by a visual judgement whether or not the position and height of the roll and other parts are correct.

Therefore, considerable labor and time are required for these operations. If the web roll is supported inaccurately, it could be damaged by hitting some hard part. Further, it is dangerous for a worker to work by a visual judgement near a heavy roll.

SUMMARY OF THE INVENTION

An object of the present invention is to provide an apparatus for automatically mounting and dismounting web rolls which obviates the above-mentioned shortcomings.

In the first and second embodiments, the present invention is applied to a mill roll stand having one or two pairs of support arms pivotally mounted on a threaded shaft or shafts. In the third and fourth embodiments, the present invention is applied to another type of mill roll stand having a pair of conveyors each carrying roll supports.

In accordance with the first and third embodiments of the present invention, the alignment of the web roll with the support shafts is performed by moving the first conveyor carrying the web roll in a lateral direction for a distance determined by computation and turning the support shafts for an angle determined by computation.

In accordance with the second and fourth embodiments of the present invention, the alignment is performed by moving the first conveyor in both lateral and vertical directions for distances determined by computation with the support members held at their predetermined position.

In the preferred embodiments, the present invention is applied to mill roll stands used in the production of corrugated fiberboard.

BRIEF DESCRIPTION OF THE DRAWINGS

Other objects and features of the present invention will become apparent from the following description taken with reference to the accompanying drawings, in which.

DESCRIPTION OF THE PREFERRED EMBODIMENTS

Figure 1:
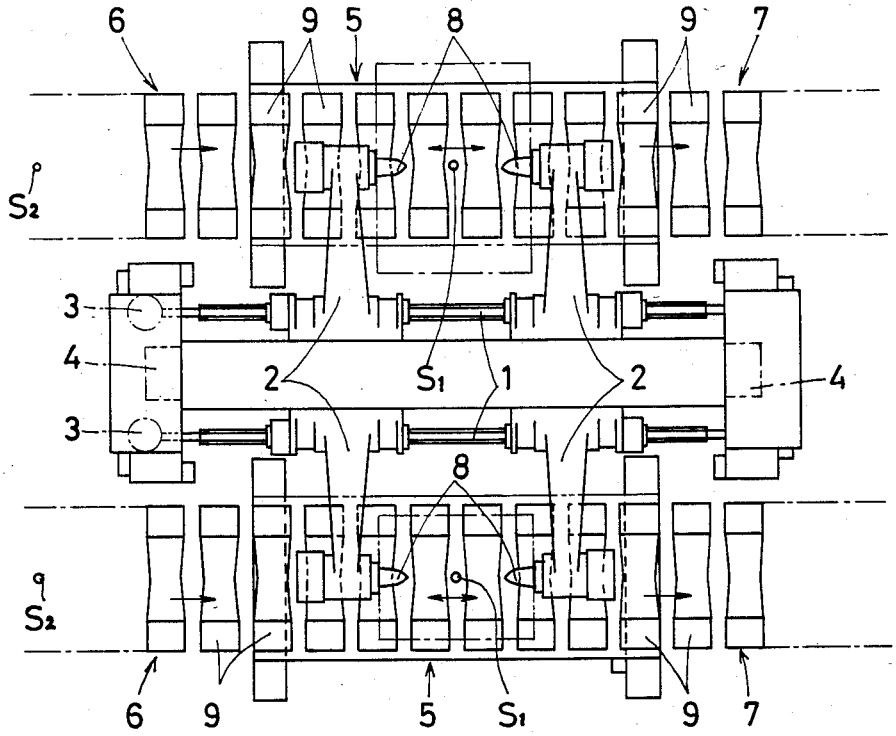
FIG. 1 is a plan view of a mill roll stand.

FIG. 1 shows a mill roll stand used in the first embodiment, which will be described below briefly.

Threaded shafts 1 are threaded differently in two directions from their center. A pair of support arms 2 are screwed on each threaded shaft 1. The mill roll stand is provided with two pairs of support arms adapted to be used alternately for continuous supply of the web to a corrugating machine. When each threaded shaft is driven by a reversible motor 3, the support arms 2 will move toward and away from each other without turning. The support arms rotatably mounted on each threaded shaft 1 can be turned around the shaft by means of an arm turning motor 4 coupled thereto through a suitable transmission.

Under the support arms 2 there is provided a first conveyor 5 which is movable both in a direction parallel to the threaded shaft 1 and in a direction perpendicular thereto. A second conveyor 6 for supplying a web roll A and a third conveyor 7 for taking it out are provided behind and in front of the first conveyor 5, respectively.

The support arms 2 each are provided at their tip with a support shaft 8 for supporting the web roll A. The web roll is supported between two support shafts 8 inserted into its center hole from both sides.

As the conveyors 5, 6 and 7, roller conveyors having minus crown rollers 9 may be used. Rollers of such a shape as illustrated are used to keep the web roll A perpendicular to the axis of the rollers 9 and at their center. Conveyors of other types such as belt conveyors and slat conveyors having a V-shape surface may be used as the conveyors 5, 6 and 7 so long as they can have the same function as the roller conveyor used.

The first embodiment of the present invention will be described.

Figure 2:
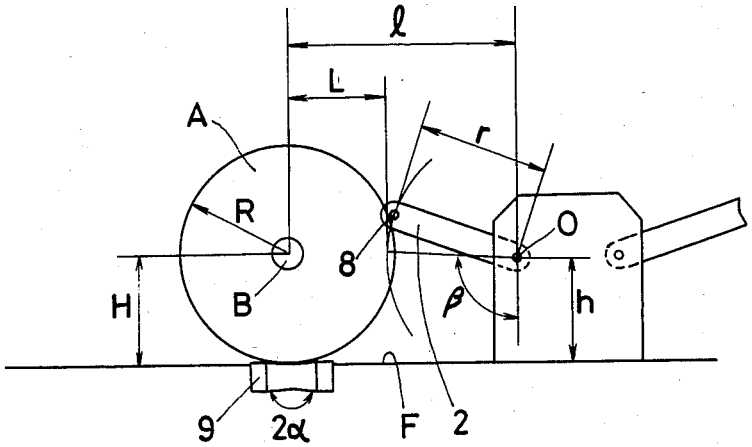
FIG. 2 is an explanatory view showing how in the first and third embodiments the support shafts are aligned with the center hole in the web roll.

Firstly, the method for aligning the support shafts 8 of the support arms 2 with the center hole B of the web roll A to be supported will be described below with reference to FIG. 2.

The height H from the floor surface F to the center of the roll A is expressed by $$H = \frac{R}{\sin \alpha} \quad (1)$$

wherein R is the radius of the roll and $2\alpha$ is the crown angle of the rollers 9. It is assumed that the lowermost part at the center of the rollers is at the same level as the floor surface F.

The support arm 2 turns around the point O which is the axis of the threaded shaft 1. Thus, the distance L for which the roll A has to move to between a pair of the support shafts 8 is expressed by $$L = l - r \sin \beta \quad (2)$$

wherein $\beta$ is an angle which the support arm 2 forms with a vertical line when they are at the height H, l the distance from the center of the roller 9 to the point O, and r the radius of the circle which the support shaft 8 draws around the point O.

The height H is also expressed as follows:

$$H = h - r \cos \beta \quad (3)$$

wherein h is the height from the surface F of floor to the point O.

From the equations (1) and (3), $$\beta = \cos^{-1} \frac{1}{r}\left(h - \frac{R}{\sin\alpha}\right) \quad (4)$$

From the equations (2) and (4), $$L = l - r\sin\left\{\cos^{-1}\frac{1}{r}\left(h - \frac{R}{\sin\alpha}\right)\right\} \quad (5)$$

By thus determining the angle $\beta$ and the distance L, the axis of the roll A can be aligned with the support shafts 8. In the equations (4) and (5), the radius r, height h, crown angle $2\alpha$, radius R, and distance l are predetermined.

Figure 3:
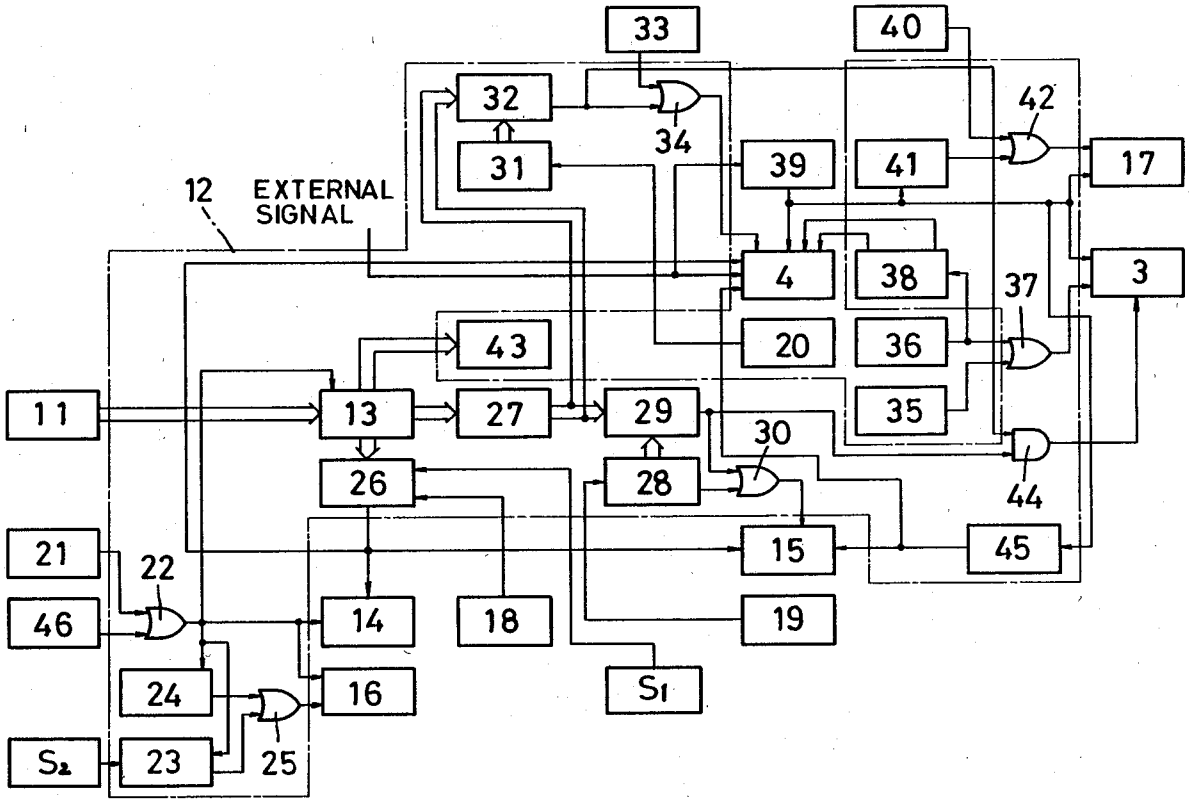
FIG. 3 is a block diagram of a control circuit used in the first embodiment.

Next, the control circuit used in the first embodiment of the present invention will be described with reference to FIG. 3.

The diameter 2R, and width, 2W, of the roll A are set in a setter 11, which gives them a memory 13 of a control unit 12. The memory can register a plurality of set values which can be changed by operating the setter 11.

The first conveyor 5 is provided with a first sensor $S_1$ for detecting the presence of the roll A, said sensor being on the center line of the mill roll stand. The second conveyor 6 is provided with a second sensor $S_2$ for the same purpose.

The rollers 9 of the first conveyor 5 are driven by a first roller drive 14. The first conveyor which forms a module is moved in a direction perpendicular to the threaded shaft 1 by a lateral drive 15. The rollers 9 of the second and third conveyors 6, 7 are driven by second and third roller drives 16, 17, respectively.

The drives 14 and 15 are provided with first and second pulse generators 18 and 19, respectively, which generate pulses, the number of which is proportional to the rotation of the rollers and to the distance of lateral movement, respectively. The motor 4 for turning the support arms 2 is provided with a third pulse generator 20 which generates pulses, the number of which is proportional to the angle by which the support arms 2 turn around the threaded shaft 1.

An OR circuit 22 gives an OR signal when it receives at least one of the signal from a supply start switch 21 and the detection signal from a supply start detector 46. In response to the OR signal, the first and second roller drives 14 and 16 are actuated. The supply start detector 46 is a sensor such as a limit switch which senses the alignment of the first conveyor 5 with the second and third conveyors 6 and 7.

A counter 23 is reset in response to the signal from the OR circuit and gives a signal each time it receives the second detection signal from the second sensor $S_2$. A timer circuit 24 gives a timer signal after a predetermined time after it has received the OR signal. When an OR circuit 25 receives a signal from the counter 23 or the timer signal from the timer circuit 24, it gives to the second roller drive 16 a signal to stop it.

In response to the detection signal from the first sensor $S_1$, a counter 26 reads the value W (half of the roll width) from the memory 13 and starts counting of the pulses from the first pulse generator 18. When the count has become equal to the value W, the counter gives a stop signal to stop the first roller drive 14. In response to the signal from the counter 26, the motor 4 is also driven to lower the support arms 2.

A computing unit 27 receives the diameter, 2R, of the roll A from the memory 13 and, on basis of the value 2R and the preset values $\alpha$, h, l, and r, performs computation expressed by the equations (4) and (5) to obtain the angle $\beta$ and the distance L of lateral movement.

A first reversible counter 28 counts the pulse signal from the second pulse generator 19. Its count is proportional to the position of the first conveyor 5 with respect to a reference point (e.g. center of the rollers 9 when the conveyor 5 is in alignment with the second and third conveyors). When the count has become equal to the value L obtained in the computing unit 27, a first comparator 29 gives a first comparison signal.

The first reversible counter 28 gives a first reference signal when its count is zero, that is, when the first conveyor 5 is at its reference point. When an OR circuit 30 receives the first reference signal or the first comparison signal from the first comparator 29, it stops the lateral drive 15. The output signal from the counter 26 starts the drive 15.

A second reversible counter 31 counts the pulse signal from the third pulse generator 20. Its count is proportional to the angle $\beta$ which the support arms 2 forms with respect to a reference point (e.g. point when the arms are in their vertical position). When the count has become equal to the value corresponding to the angle $\beta$ obtained in the computing unit 27, a second comparator 32 gives a second comparison signal. An OR circuit 34 gives a signal for stopping the arm turning motor 4 when it receives the second comparison signal or a detection signal from a stop position detector 33 which detects the support arms 2 at their predetermined position (where the angle $\beta$ is maximum).

When an AND circuit 44 receives both the signal from the first comparator 29 and the signal from the second comparator 32, it actuates the reversible motor 3 to bring the support shafts 8 toward each other to support the roll A. When an OR circuit 37 receives a signal from an open detector 35 for detecting that the support shafts 8 are fully open, or a signal from a support detector 36 for detecting that the roll A has been completely supported between the support shafts 8, It will stop the reversible motor 3. The open detector 35 and the support detector 36 may be a current detector which detects the current value for the reversible motor 3 above a predetermined level, or a moving distance detector which detects that the support shaft 8 has moved for a predetermined distance.

Some time after receipt of the signal from the support detector 36, a timer circuit 38 actuates the arm turning motor 4 to move the support arms 2 to a predetermined position and, some further time thereafter, stops the motor 4.

In response to an external signal showing the completion of supply of web from the roll, e.g. a splice signal, the arm turning motor 4 lowers the support arms 2. Upon detection of the web roll by a discharge detector 39, the arm turning motor 4 is stopped. Some time after that, the reversible motor 3 is driven to move the support shafts 8 away from the partially used web roll. The discharge detector is provided under and between the support arms 2. It outputs only the first detection signal after receipt of the web supply complete signal.

The detection signal starts the third roller drive 17, which is stopped by a signal from an OR circuit 42. It gives the signal when it receives the signal from a discharged roll detector 40 provided at end of the third conveyor 7 or the signal from a timer circuit 41 connected to the discharge detector 39.

A display 43 indicates the diameters, 2R, and the widths, 2W, of the web roll from which the web is being supplied and of the web roll to be supported next.

The lateral drive 15 is moved back to its reference position by a signal from a timer circuit 45 given some time after the detection of the roll by the discharge detector 39. It is stopped through the OR circuit 30 in response to the signal from the first reversible counter 28.

Each time the memory 13 receives the signal from the OR circuit 22, the values that have been used for computation are cancelled and the next set of registered values are used thereafter. The arm turning motor 4 is actuated to raise the support arms 2 in response to the signal from the timer circuit 45 and is stopped in response to the signal from the stop position detector 33 which detects the arrival of the support arms 2 at their predetermined position.

The overall operation of the first embodiment will be described below.

Let us assume that no web roll is now supported on the support arms 2 and that several web rolls of different diameters and widths need to be supported thereon one after another in a predetermined order. Firstly, the diameters, 2R, and widths, 2W, of the web rolls to be supported are set in the setter 11 in the predetermined order and are stored in the memory 13.

The supply start switch 21 is switched on. It actuates the first roller drive 14 and the second roller drive 16 to move the first web roll A on the second conveyor 6 and then on the first conveyor 5.

When it comes to the center of the first conveyor, the first sensor $S_1$ detects it. When the count of the counter 26 becomes equal to the value W (half of the roll width), the first roller drive 14 stops and the lateral drive 15 starts. As the first conveyor 5 moves in a lateral direction, the second pulse generator 19 generates pulses accordingly. The pulses are counted by the first reversible counter 28. When its count becomes equal to a value corresponding to the distance L of lateral movement determined by the computing unit 27, the first comparator 29 will stop the lateral drive 15. The second roller drive 16 is stopped through the counter 23 and the OR circuit 25 upon the second detection of the roll by the second sensor $S_2$.

The arm turning motor 4 is actuated by a signal from the counter 26 and is stopped by the second comparator 32 when the angle of the support arm 2 becomes equal to the angle $\beta$ determined by the computing unit 27. When the roll comes into alignment with the support shafts 8, the AND circuit 44 gets signals from the first and second comparators 29, 32 and actuates the reversible motor 3 to move the support shafts 8 toward each other.

When the web roll has been supported by the support shafts 8, the support detector 36 detects it from the fact that the current supplied to the reversible motor 3 increases, beyond a limit value, so that the motor 3 will be stopped. Some time after the support of the roll, the timer circuit 38 starts the arm turning motor 4 and stops it when the roll has come to its predetermined position of web supply.

The web is supplied to the corrugating machine from the web roll thus supported on the arms 2. When a required length of web has been supplied, the web is cut by the web splicer to prepare splicing to a new web supported on another pair of support arms. In response to the web supply complete signal given upon cutting of the old web, the arm turning motor 4 is actuated to lower the support arms. When the roll on the first conveyor is detected by the discharge detector 39, the motor 4 is stopped. Some time after that, the timer circuit 45 actuates the lateral drive 15 to move the first conveyor 5 carrying the roll to such a position where the first, second and third conveyors are aligned with one another. Simultaneously, the arm turning motor 4 is actuated to bring the support arms 2 to their uppermost position. The third roller drive 17 is stopped either upon detection of the web roll on the third conveyor 7 by the discharged roll detector 40 or a preset time after its start.

When the web roll has been dismounted from the support arms and discharged and the first, second and third conveyors are in alignment with one another, the supply start detector 46 will detect the first conveyor 5 and the OR circuit 22 gives an OR signal. Thus, the above-mentioned operation will be repeated.

Next, the second embodiment will be described. It, too, is applied to the conventional mill roll stand. The arrangement for mounting and dismounting the web roll on the roll stand is basically the same as in the first embodiment except for the following points.

In the first embodiment, the alignment of the support shafts with the center hole of the web roll is performed by moving the web roll on the first conveyor in a lateral direction to between the support arms and by turning the support arms to the same height as the center hole of the web roll. In the second embodiment, it is performed by moving the web roll on the first conveyor in both lateral and vertical directions with the support arms kept at a predetermined height.

Figure 4:
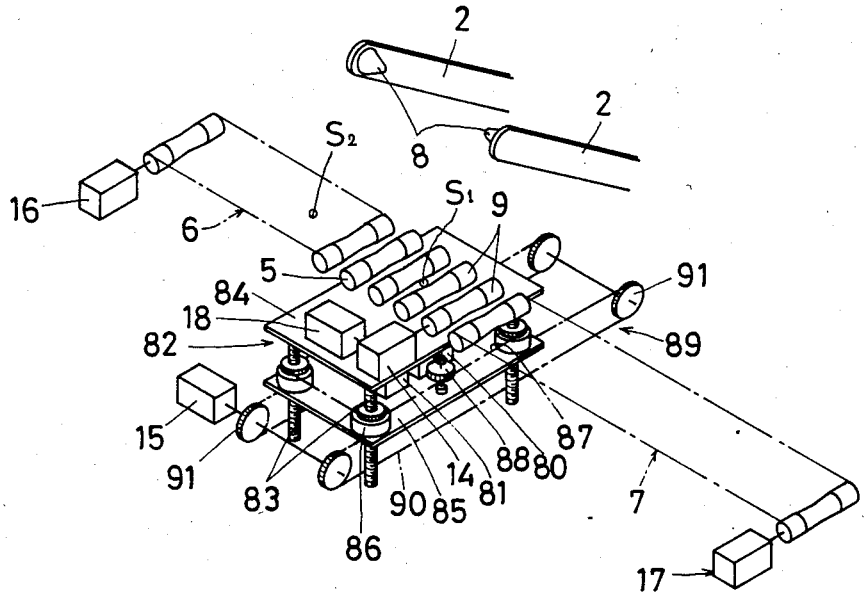
FIG. 4 is the arrangement for lateral and vertical movement of the first conveyor in the second embodiment.

FIG. 4 shows a basic arrangement used in the second embodiment. The same numerals are used for the same or similar parts as in the first embodiment. The rollers 9 of the first, second and third conveyors 5, 6 and 7 are driven by the first, second and third roller drives 14, 16 and 17. The first conveyor 5 which forms a module is moved by the lateral drive 15 in a lateral direction perpendicular to the threaded shaft 1 and by a vertical drive 80 in a vertical direction.

In this embodiment, too, the first and second sensors $S_1$, $S_2$ are provided and the first roller drive 14 is provided with the first pulse generator 18. Besides, the vertical drive 80 is provided with a second pulse generator 81 for generating pulses proportional to the amount of vertical movement.

The vertical drive 80 drives a vertical displacement unit 82 for vertically displacing the first conveyor 5. The vertical displacement unit comprises four threaded shafts 83 secured to a mounting plate 84 of the first conveyor, a support plate 85 for rotatably supporting nuts 86 engaging the threaded shafts 83, and a chain 87 for rotating the nuts 86. When the chain 87 is rotated by the vertical drive 80 through a sprocket 88 and a transmission, the nuts 86 are rotated, thereby vertically displacing the first conveyor 5. The lateral drive 15 drives a lateral displacement unit 89 for laterally displacing the support plate 85 supporting the first conveyor 5. The lateral displacement unit comprises chains 90 secured to the support plate 85, and sprockets 91 for supporting the chains 90. The first conveyor 5 is laterally displaced together with the support plate when the sprockets 91 are rotated by the lateral drive 15. The vertical and lateral displacement units 82, 89 are not limited to the above-mentioned arrangement but optional insofar as the function is the same.

The method according to the second embodiment will be described in detail hereinunder.

Figure 5:
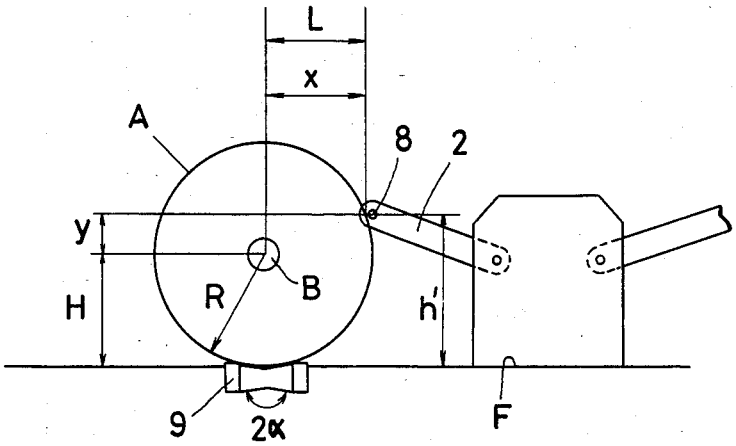
FIG. 5 is a view similar to FIG. 2 in the second and fourth embodiments.

The method for aligning the support shafts 8 of the support arms 2 with the center hole B formed in the center of the web roll A will be described with reference to FIG. 5. Suppose that the lowermost part at the center of the rollers 9 is at the same level as the floor surface F, and that the support shafts 8 on the support arms 2 are apart from the center of the rollers 9 horizontally by a distance L and vertically by a distance h'. Then the height H from the floor surface to the center of the roll A is as follows.

$$H = \frac{R}{\sin \alpha} \tag{1}$$

wherein R is the radius of the roll and $2\alpha$ is the crown angle of the rollers 9. Thus the amount of horizontal displacement x and that of vertical displacement y for aligning the center hole B of the roll A with the support shafts 8 of the support arms 2 are expressed as follows:

$$x = L \tag{6}$$

$$y = h' - H \tag{7}$$

From the equationa (1) and (7), $$y = h' - \frac{R}{\sin \alpha} \tag{8}$$

By calculating the amounts of horizontal and vertical displacements as described hereinabove, the axis of the roll A can be aligned with the support shafts 8. In equations (6) and (8), the horizontal distance L and the vertical distance h' from the center of the roll to the support shafts 8, the crown angle $2\alpha$ of the rollers 9 and the radius R of the roll A are predetermined values.

Figure 6:
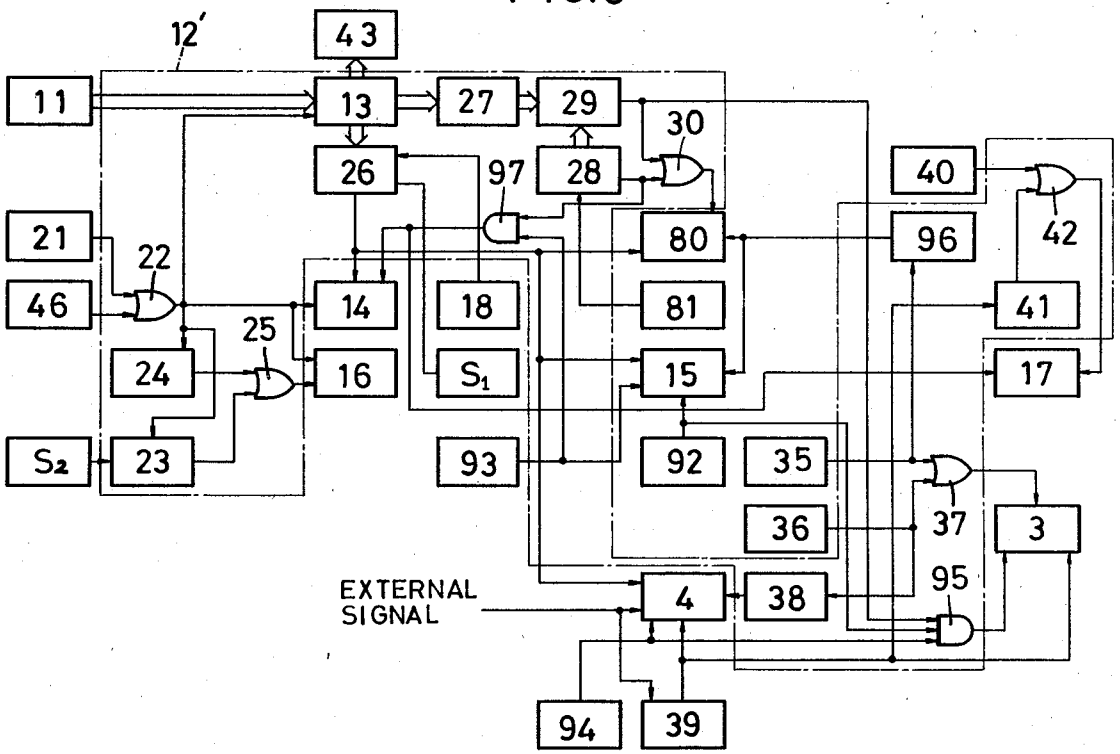
FIG. 6 is a block diagram of a control circuit used in the second embodiment.

Next, the control circuit used in the second embodiment will be described with reference to FIG. 6. The same numerals are employed for the same parts as in the first embodiment.

The setter 11 and the memory 13 in the control unit 12' perform the same function as in the first embodiment.

The OR circuit 22 gives an OR signal when it receives the signal from the supply start switch 21 or the signal from the supply start detector 46. In response to the OR signal, the first and second roller drives 14 and 16 are actuated. The supply start detector 46 is a sensor such as a limit switch which senses the first conveyor 5 aligned with the second and third conveyors 6 and 7 and at the same level with them.

A counter 23 is reset in response to the signal from the OR circuit and gives a signal each time it receives the second detection signal from the second sensor $S_2$. A timer circuit 24 gives a timer signal after a predetermined time after it has received the OR signal. When an OR circuit 25 receives a signal from the counter 23 of the timer signal from the timer circuit 24, it gives to the second roller drive 16 a signal to stop it.

In response to the detection signal from the first sensor $S_1$, a counter 26 reads the value W (half of the roll width) from the memory 13 and starts counting of the pulses from the first pulse generator 18. When the count has become equal to the value W, the counter gives a stop signal to stop the first roller drive 14. In response to the signal from the counter 26, the motor 4 is also driven to lower the support arms 2.

A computing unit 27 receives the diameter, 2R, of the roll A from the memory 13 and, on basis of the value 2R and the preset values $\alpha$, h' performs computation expressed by the equations (7) and (8) to obtain the distance y of vertical movement.

A reversible counter 28 counts the pulse signal from the second pulse generator 81. Its count is proportional to the vertical position of the first conveyor 5 with respect to its reference point (e.g. where the center of the rollers 9 is level with the floor surface). When the count has become equal to the value y obtained in the computing unit 27, a comparator 29 gives a comparison signal.

The reversible counter 28 gives a reference signal when its count is zero, that is, when the first conveyor 5 is at its reference point. When an OR circuit 30 receives the reference signal or the comparison signal from the comparator 29, it stops the vertical drive 80. The output signal from the counter 26 starts the drive 80.

In response to the signal from the counter 26, the lateral drive 15 is actuated to move the first conveyor 5 from its starting point toward the support arms 2 and stopped by the signal from an end point detector 92. The starting point detector may be a limit switch or the like detecting the alignment of the first, second and third conveyors with one another. The end point detector may be a limit switch or the like detecting that the web roll is at such a position that its center hole is directly under or aligned with the support shafts 8 of the support arms 2 at their predetermined position.

The signal from the counter 26 actuates the arm turning motor 4 to lower the support arms 2 to the predetermined position. The motor 4 is stopped in response to a signal from a support position detector 94. If the support arms 2 are not detected, the motor 4 is kept driven so that the arms 2 will go down to the lowermost point and then go up. It is stopped when the detector 94 senses the arms in an upward movement. The abovesaid predetermined position or support position is a position where the support arms 2 can support the web roll of even the largest diameter.

When an AND circuit 95 receives all of the signal from the comparator 29, the signal from the end point detector 92 and the signal from the support position detector 94, it actuates the reversible motor 3 to bring the support shafts 8 toward each other to support the roll A. When the OR circuit 37 receives a signal from an open detector 35 for detecting that the support shafts 8 are fully open, or a signal from a support detector 36 for detecting that the roll A has been completely supported between the support shafts 8, it will stop the reversible motor 3.

Some time after receipt of the signal from the support detector 36, a timer circuit 38 actuates the arm turning motor 4 for a short time to slightly raise the support arms 2 to bring the web roll up away from the first conveyor 5.

In response to an external signal showing the completion of supply of web from the roll, e.g. a splice signal, the arm turning motor 4 lowers the support arms 2. Upon detection of the partially used web roll by a discharge detector 39, the arm turning motor 4 is stopped. Simultaneously or some time after that, the reversible motor 3 is driven to move the support shafts 8 away from the web roll. The discharge detector is provided under and between the support arms 2. It outputs only the first detection signal after receipt of the web supply complete signal.

The signal from the open detector 35 stops the reversible motor 3 through the OR circuit 37. Some time after receipt of the signal from the open detector 35, a timer circuit 96 actuates the lateral drive 15 and the vertical drive 80 so that the first conveyor will go back to its starting point at the reference height. The lateral drive is stopped by the signal from the starting point detector 93 and the vertical drive is stopped through the OR circuit 30 by the signal from the reversible counter 28.

The third roller drive 17 is stopped by a signal given by the OR circuit 42 when it receives the signal from the discharged roll detector 40 or the signal from the timer circuit 41 connected to the discharge detector 39.

When an AND circuit 97 receives both of the signal from the starting point detector 93 and the signal from the reversible counter 28, the first and third roller drives 14, 17 will be stopped some time after the signal from the AND circuit 97.

The overall operation of the second embodiment will be described below.

Let us assume that no web roll is now supported on the support arms 2 and that several web rolls of different diameters and widths need to be supported thereon one after another in a predetermined order. Firstly, the diameters, 2R, and widths, 2W, of the web rolls to be supported are set in the setter 11 in the predetermined order and are stored in the memory 13.

The supply start switch 21 is switched on. It actuates the first and second roller drives 14, 16 to move the first web roll A on the second conveyor 6 and then on the first conveyor 5.

When it comes to the center of the first conveyor, the first sensor $S_1$ detects it. When the count of the counter 26 becomes equal to the value W (half of the roll width), the first roller drive 14 stops and the lateral and vertical drives 15, 80 start. As the first conveyor 5 moves in a vertical direction, the second pulse generator 81 generates pulses accordingly. The pulses are counted by the reversible counter 28. When its count becomes equal to a value corresponding to the distance y of vertical movement determined by the computing unit 27, the comparator 29 will stop the vertical drive 80. The lateral drive 15 is started simultaneously with the vertical drive to move the first conveyor toward the end point and is stopped in response to the signal from the end point detector 92. The second roller drive 16 is stopped through the counter 23 and the OR circuit 25 upon the second detection of the roll by the second sensor $S_2$.

The arm turning motor 4 is actuated by a signal from the counter 26 and is stopped by the support position detector 94 when the support arms 2 have come to the predetermined support position. When the roll comes into alignment with the support shafts 8, the AND circuit 95 gets signals from the comparator 29, end point detector 92 and support position detector 94 and actuates the reversible motor 3 to move the support shafts 8 toward each other.

When the web roll has been supported by the support shafts 8, the support detector 36 detects it from the fact that the current supplied to the reversible motor 3 increases beyond a limit value, so that the motor 3 will be stopped. Some time after the support of the roll, the timer circuit 38 actuates the arm turning motor 4 to raise the support arms 2 slightly to bring the web roll away from the rollers 9.

The web is supplied to the corrugating machine from the web roll thus supported on the arms 2. When a required length of web has been supplied, the web is cut by the web splicer to prepare splicing to a new web. In response to the web supply complete signal given upon cutting of the old web, the arm turning motor 4 is actuated to lower the support arms. When the roll core or partially used roll is detected by the discharge detector 39, the motor 4 is stopped. Simultaneously the reversible motor 3 is driven to move the support arms away from each other. Now the partially used roll is on the first conveyor 5. When the support shafts are fully open, the open detector 35 will stop the reversible motor 3.

Some time thereafter, the timer circuit 96 actuates the lateral and vertical drives 15 and 80 to move the first conveyor 5 back to its starting point at the reference height. They are stopped in response to the signal from the starting point detector 93 and the zero signal from the reversible counter 28, respectively.

When the first conveyor 5 is aligned with and at the same height as the second and third conveyors, the first and third roller drives 14, 17 are driven to move the web roll from the first conveyor to the third conveyor 7. The third roller drive 17 is stopped either in response to the signal from the discharged roll detector 40 or the signal from the timer circuit 41.

When the supply start detector 46 detects the first conveyor 5, the OR circuit 22 will give a signal, and the above-mentioned steps are repeated.

With reference to FIGS. 7–10, the third embodiment of the present invention will be described. It is applied to another type of the mill roll stand, but this embodiment is similar to the first embodiment in that the axis of the web roll to be supported is aligned with the support shafts 8 by moving the first conveyor laterally and turning the support arms to the same level as the axis of the web roll, not by moving the first conveyor in both lateral and vertical directions as in the second embodiment.

Referring to FIGS. 7–10, the mill roll stand has a pair of conveyors 51 spaced from each other and adapted to be driven in a synchronous manner. Each conveyor 51 carries two or more roll supports 52 equally spaced from one another. The roll supports on one conveyor are opposed to those on the other conveyor.

Each conveyor 51 has an endless chain 53 passing around sprockets 54 each mounted on the inner end of a cantilever shaft 55. Each conveyor 51 is provided with a guide unit 56 for both the upper and lower sections of the endless chain 53. But, the guide unit for its lower section can be omitted. The guide unit 56 comprises channel rails 57 and rollers 60 mounted on each end of pins 59 for coupling links 58 of which the endless chain 53 consists.

The cantilever shafts 55 are coupled through a transmission 62 to a motor 61 to drive the conveyors 51 synchronously.

Each roll support 52 is provided with a support shaft 63 slidable toward and away from that of the opposed roll support. The roll support has a through hole 65 through which a slide pipe 64 extends. The support shaft 63 extends through the slide pipe 64, journalled by bearings **64*a*** at each end of the slide pipe.

A mounting plate 66 is fixedly mounted on the slide pipe 64 at its outer end. A male screw 67 parallel to the slide pipe has its outer end fixed to the mounting plate 66. A female screw (not shown) is threadedly mounted on the male screw and journalled so as to turn at a fixed position. A gear 68 integral with the female screw meshes with a gear (not shown) on the shaft of a reversible motor 70, directly or through a transmission. When the motor starts, its rotation is transmitted through the gear 68 to the male screw 67, which moves to the right or left, together with the support shaft 63. A brake 72 is provided for the support shafts 63.

Figure 7:
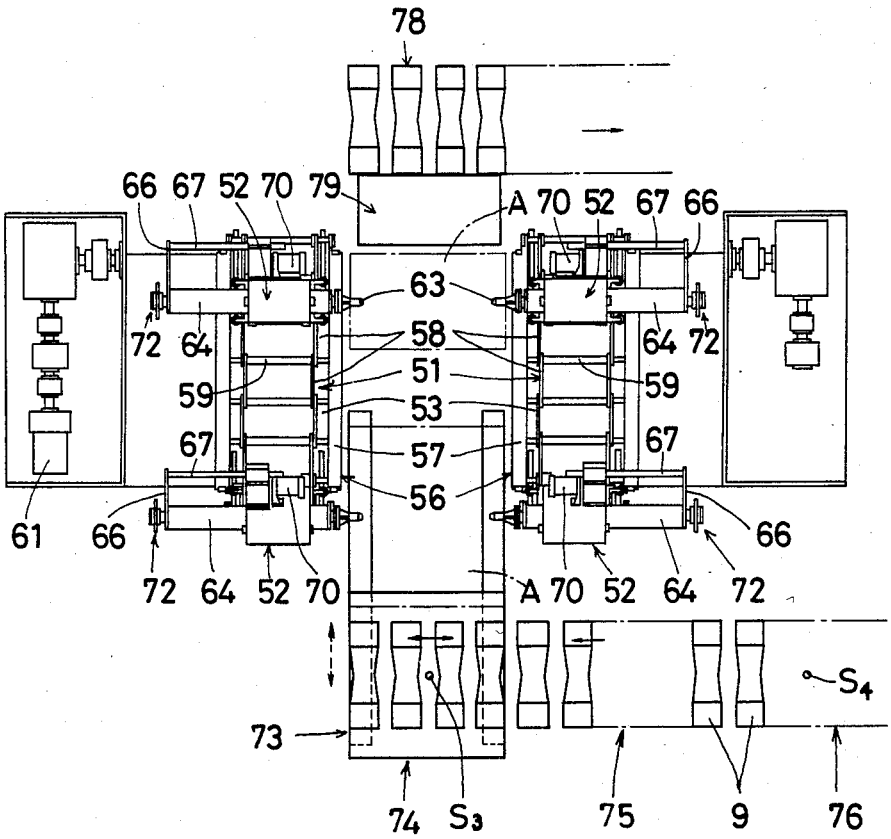
FIG. 7 is a plan view of another mill roll stand.
Figure 8:
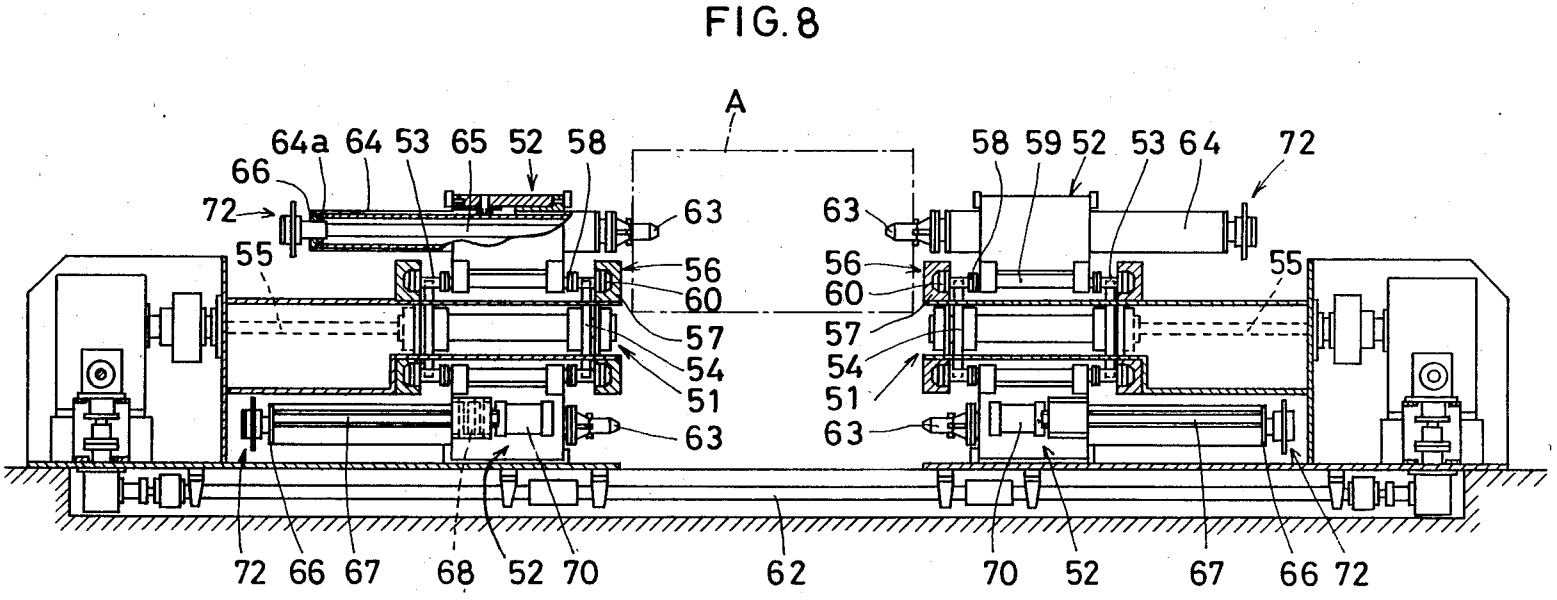
FIG. 8 is a vertical sectional view thereof.
Figure 9:
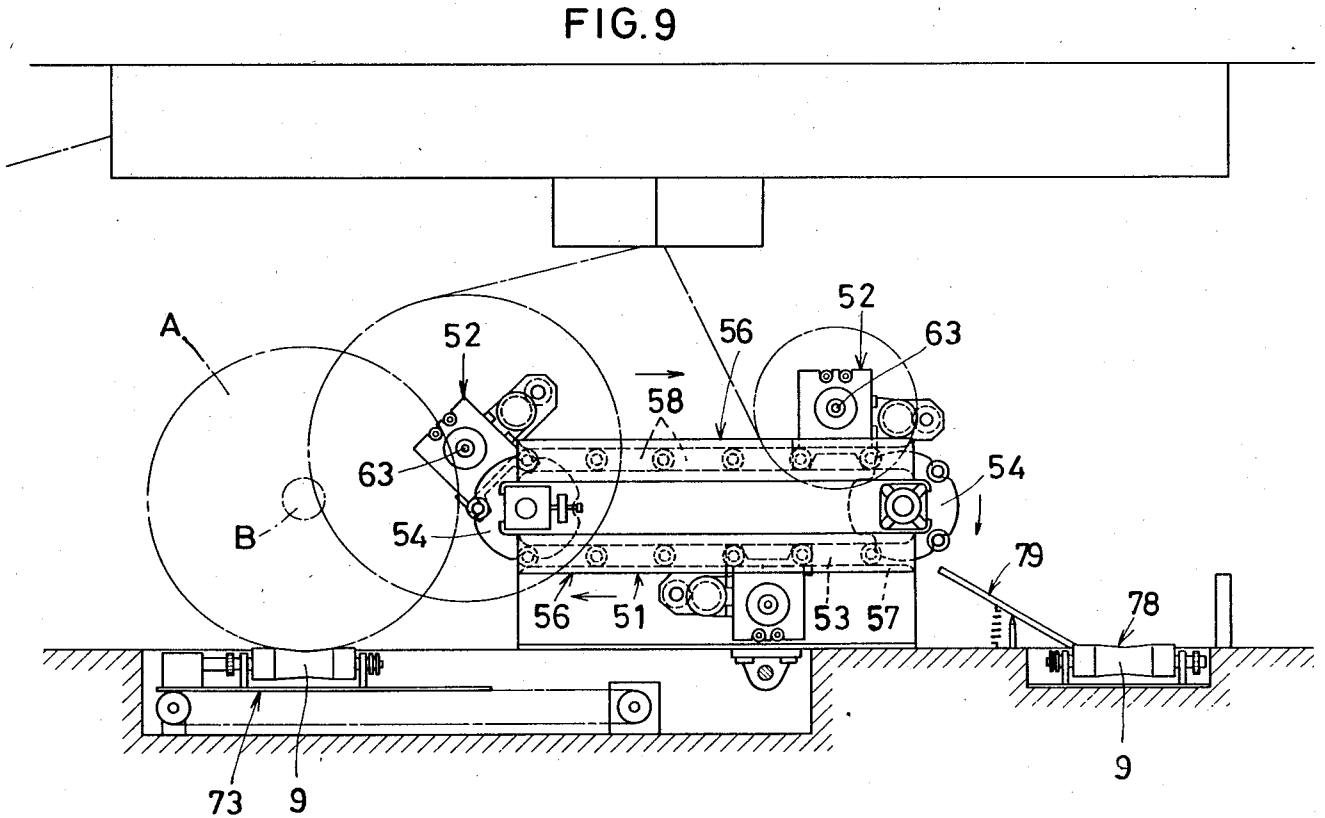
FIG. 9 is a side view thereof.

Referring to FIG. 7, a roll supply unit 73 for supplying the web rolls to the roll support 52 has three conveyors 74, 75 and 76 driven independently. The second and third conveyors 75, 76 move in a direction perpendicular to the direction in which the conveyor 51 moves. The first conveyor 74 moves in directions both parallel to and perpendicular to that direction. All of these conveyors are roller conveyors using the same minus crown rollers 9 as shown in FIG. 1. The second conveyor 75 is provided to prevent the web roll being conveyed from hitting against the roll support 52. If the roll supply unit 73 is sufficiently away from the conveyor 51, the second conveyor may be omitted.

Furthermore, the fourth conveyor 78 is provided to take the partially used roll out of the roll supports 52 after a required length of web has been supplied therefrom.

Between the end of the conveyor 51 and the fourth conveyor 78, a discharged roll detector 79 is provided to detect the arrival of the web roll supported by a pair of the roll supports 52 at a position for discharge. The detector 79 projects about half way between the two conveyors 51 and senses the roll by touching it.

The apparatus according to the present invention as applied to the above-mentioned mill roll stand will be described below. This will be referred to as the third embodiment.

In this embodiment, the angle $\beta$ and the distance L of lateral movement for the first conveyor 74 may be determined theoretically in the same manner as in the first embodiment, or may be obtained by actual measurement.

The reversible motor for the roll supports 52 by which a web roll is to be supported will be denoted as **70*a* and the one for the roll supports from which the web roll is to be taken out will be denoted as 70*b***.

Figure 10:
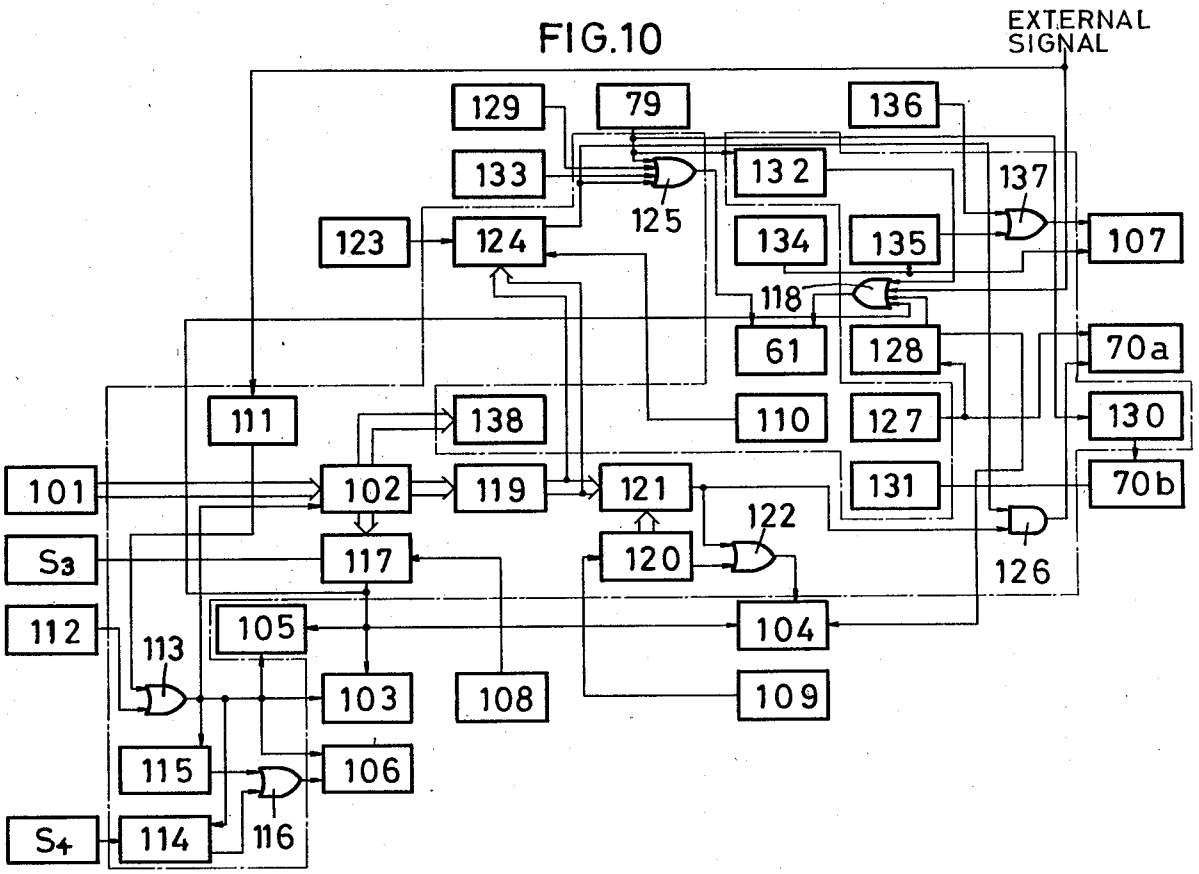
FIG. 10 is a block diagram of a control circuit used in the third embodiment.
Figure 11:
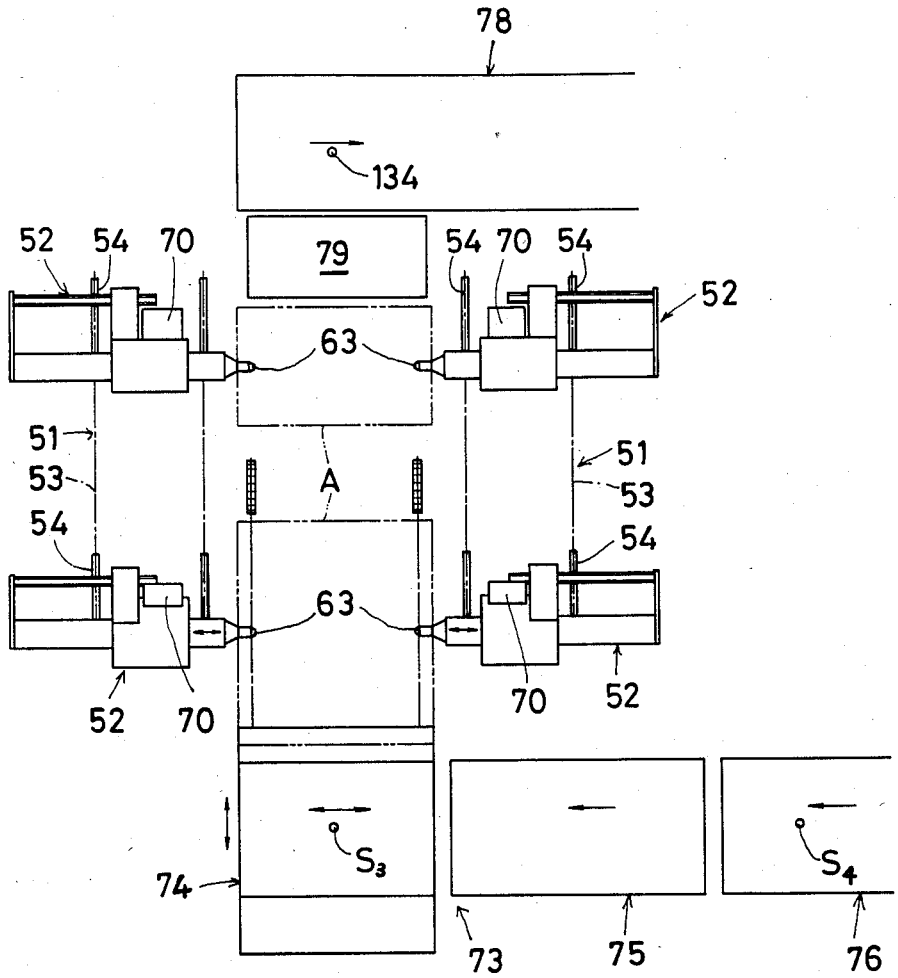
FIG. 11 is a plan view of the arrangement used in the fourth embodiment.
Figure 12:
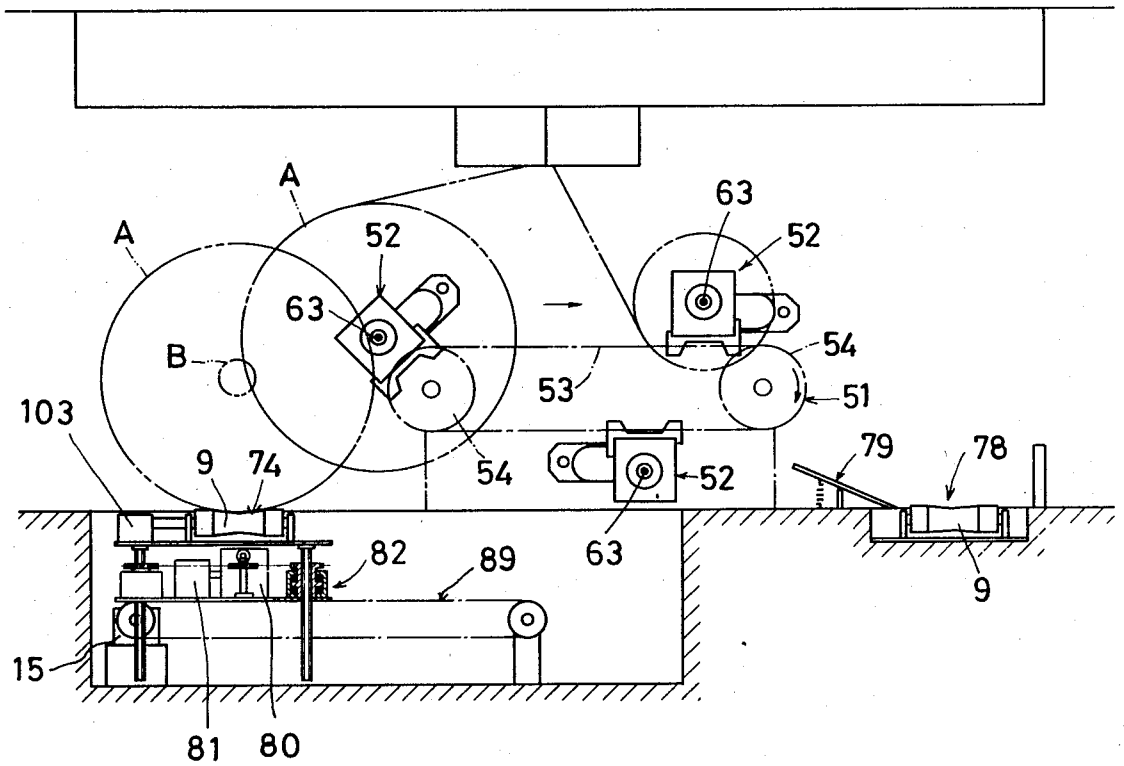
FIG. 12 is a side view thereof.

In FIG. 10 showing a block diagram of the control circuit used in the third embodiment, the diameter, 2R, and width, 2W, of the roll A are set in a setter 101, which gives them a memory 102 of a control unit 139. The memory can register a plurality of set values which can be changed by operating the setter 101.

The first conveyor 74 is provided with a first sensor $S_3$ for detecting the presence of the roll A, said sensor being on the center line of the mill roll stand. The third conveyor 76 is provided at a position near to the second conveyor 75 with a second sensor $S_4$ for the same purpose.

The rollers 9 of the first conveyor 74 are driven by a first roller drive 103. The first conveyor is moved in a direction perpendicular to the axis of the support shaft by a lateral drive 104. The rollers 9 of the second, third and fourth conveyors 75, 76 and 78 are driven by second, third and fourth roller drives 105, 106, 107, respectively.

The first drive 103 is provided with a first pulse generators 108 which generate pulses, the number of which is proportional to the revolutions of the rollers 9. The lateral drive 104 and the motor 61 for the conveyor 51 are provided with second and third pulse generators 109 and 110, respectively. They generate pulses, the number of which is proportional to the distances for which the first conveyor 74 and the roll supports 52 have moved, respectively.

A timer circuit 111 receives an external signal indicating that the supply of web from the web roll supported on the roll supports 52 has completed, e.g. a splicing complete signal from the splicer, and, gives a signal a predetermined time after the receipt.

An OR circuit 113 gives an OR signal when it receives at least one of the signal from the timer circuit 111 and the signal from a supply start switch 112. In response to the OR signal, the first, second and third roller drives 103, 105 and 106 are driven.

A counter 114 is reset in response to the signal from the OR circuit and gives a signal each time it receives the second detection signal from the second sensor $S_4$. A timer circuit 115 gives a signal after a predetermined time after it has received the OR signal. When an OR circuit 116 receives the signal from the counter 114 or the signal from the timer circuit 115, it stops the third roller drive 106.

In response to the detection signal from the first sensor $S_3$, a first counter 117 reads the value W (half of the roll width) from the memory 102 and starts counting of the pulses from the first pulse generator 108. When the count has become equal to the value W, the first counter gives a signal to stop the first and second roller drives 103 and 105. In response to the signal from the first counter 117, the motor 61 for the conveyor 51 is driven through an OR circuit 118.

A computing unit 119 receives the diameter, 2R, of the roll A from the memory 102 and, on basis of the value 2R and the preset values $\alpha$, h, l, and r, performs computation expressed by the equations (4) and (5) to obtain the angle $\beta$ and the distance L of lateral movement.

A first reversible counter 120 counts the pulse signal from the second pulse generator 109. Its count is proportional to the position of the first conveyor 74 with respect to the reference point (e.g. point where the first, second and third conveyors are in alignment with one another). When the count has become equal to the value L obtained in the computing unit 119, a comparator 121 gives a comparison signal.

The reversible counter 120 gives a reference signal when its count is zero, that is, when the first conveyor 74 is at its reference point. Upon receipt of the reference signal or the comparison signal from the comparator 121, an OR circuit 122 stops the lateral drive 104. The signal from the first counter 117 actuates the drive 104 and the motor 61 for the conveyor 51.

A second counter 124 counts the pulse signal from the third pulse generator 110. The second counter reads the value corresponding to the angle $\beta$ obtained in the computing unit 119 and starts counting in response to the signal from a passage detector 123 which detects the passage of the support shafts 63 directly under the sprocket 54 at the roll supply side. When its count has become equal to the value corresponding to the angle $\beta$, it gives a signal to stop the motor 61 for the conveyor 51.

When an AND circuit 126 receives both the signal from the second counter 124 and the comparison signal from the comparator 121, it actuates the reversible motor 70*a* to bring the support shafts 63 toward each other to support the roll A. In response to a signal from a support detector 127 for detecting that the roll A has been completely supported between the support shafts 63, the reversible motor 70*a* stops.

Some time after receipt of the signal from a support detector 127, a timer circuit 128 gives to the OR circuit 118 a signal for actuating the motor 61 for the conveyor 51, and stops the motor 4. The motor 61 is stopped in response to a detection signal from a first roll support detector 129 which detects the arrival of the roll supports 52 at a predetermined position.

The detector 129 may be a detector which detects that the pulses from the third pulse generator 110 has reached to a predetermined count after detection by the passage detector 123. It may also be replaced with a timer circuit adapted to give a signal a predetermined time after the timer circuit 128 has given a timer signal.

Some time after the giving of a signal actuating the motor 61 for the conveyor 51, the timer circuit 128 gives a signal to actuate the lateral drive 104 to move the first conveyor 74 back to the reference point.

The splice complete signal as an external signal actuates the motor 61 for the conveyor 51 through an OR circuit 118. The motor is stopped in response to a signal given through the OR circuit 125 from a discharge detector 79 which detects the web roll being carried out.

A predetermined time after the receipt of the signal from the discharge detector 79, a timer circuit 130 gives a timer signal to actuate the reversible motor 70*b* for the roll supports 52 at the discharge side so that the support shafts 63 will move away from each other out of the center hole in the web roll. The reversible motor 70*b* may be adapted to be directly actuated in response to the signal from the discharge detector 79, not through the timer circuit 130. The reversible motor 70*b* is stopped in response to the signal from an open detector 131 which detects the support shafts 63 at their fully open position.

The motor 61 for the conveyor 51 is actuated in response to a signal from a signal detector 132 which detects the fall of the signal given from the discharge detector 79 through the OR circuit 118, and is stopped by a signal given from a second roll support detector 133 (provided under the sprocket 54 at the discharge side) through the OR circuit 125.

When the released roll is put on the fourth conveyor 78, it is detected by a discharge complete detector 134 provided on the conveyor. The fourth roller drive 107 is actuated in response to a signal from the detector 134 and is stopped through an OR circuit 137 either by a timer circuit 135 a predetermined time after the aforesaid signal or by the signal from a discharged roll detector 136 provided at the rear end of the fourth conveyor 78.

Each time the memory 102 receives the signal from the OR circuit 113, the values that have been used for computation are cancelled from the memory and the set of the values used for the next computation is renewed. The change of the values used for computation may be made in any manner.

A display 138 receives the values registered in the memory 102 and indicates the diameters 2R and widths 2W of three rolls, i.e., the roll from which the web is being supplied to the corrugator, the next roll from which the web is to be supplied thereto, and the roll to be supported next on the support shafts 63. However, it may be adapted to indicate other values.

Next, the overall operation of the third embodiment will be described.

Firstly, when a predetermined length of the web has been supplied to the corrugator from the web roll supported on the roll supports 52 and a splice complete signal is given, the motor 61 for the conveyor 51 is driven. When the partially used web roll moves and is detected by the discharge detector 79, the signal from the detector stops the motor 61 and actuates the reversible motor 70*b* for the roll supports 52 so as to move the support shafts 63 away from each other.

Upon the fall of the signal from the discharge detector 79 detecting the web roll that has been released from the support shafts 63, the motor 61 is restarted to drive the conveyor 51 until the roll supports 52 are detected by the second roll support detector 133. When the web roll is discharged out of the roll supports 52 and detected by the discharge complete detector 134, the fourth conveyor 78 is driven to carry away the web roll.

A predetermined time after the giving of the splice complete signal, the timer circuit 111 gives a signal to the OR circuit 113. In response to the signal from the OR circuit, the first, second and third conveyors 74, 75 and 76 are driven so that the web roll will be carried about to the center of the first conveyor 74.

The first conveyor is moved by the lateral drive 104 for the distance L of lateral movement computed in the computing unit 119. The roll supports 52 are moved by the motor 61 to a position corresponding to the angle $\beta$ computed in the computing unit 119.

The fourth roller drive 107 for the fourth conveyor 78 is stopped either upon detection of the discharged roll by the discharged roll detector 136 or a predetermined time after it has started. The third roller drive 106 is stopped either upon the second detection of the web roll by the second sensor $S_4$ or a predetermined time after its start.

When both the comparison signal from the comparator 121 and the signal from the second counter 124 are given, both the lateral drive 104 and the motor 61 for conveyor 51 are stopped. Now the support shafts 63 are in alignment with the center hole B in the web roll A.

The reversible motor 70a will be driven to move the support shafts 63 toward each other until the web roll is supported by the support shafts. When this is detected by the support detector 127, the motor 61 will be actuated again to move the roll supports 52 to a standby position for web supply. Thereafter, the first conveyor 74 is moved back to the reference position by the lateral drive 104.

By repeating the above-mentioned steps, a plurality of web rolls can be supported on and released from the mill roll stand one after another automatically and continuously.

The supply start switch 112 is provided to start operation in case of emergency or if no web roll is supported on the roll supports 52.

Next, the fourth embodiment will be described with reference to FIGS. 11–14. It is applied to a mill roll stand substantially the same as the one in the third embodiment. However, this embodiment is similar to the second embodiment in that the alignment of the support arms with the center hole of the web roll is performed by moving the web roll on the first conveyor in both lateral and vertical directions with the support arms kept at a predetermined height.

As mentioned above, the mill roll stand for which this embodiment is applied is basically the same as the one in the third embodiment. Therefore, it is not described here in detail. For the same or similar parts, like numerals are employed in FIGS. 11–14.

Endless chains 53 pass around the sprockets 54 which are driven by the motor 61. The roll supports 52 are provided with support shafts 63 axially movable. Each opposed pair of the support shafts 63 are driven by the reversible motor 70 to move toward each other. The support shafts are adapted to turn together with the web roll A supported thereby.

The first to fourth conveyors 74, 75, 76 and 78 using minus crown rollers 9 are driven by the first to fourth drives 103, 104 106 and 107.

The first conveyor 74 is provided with the first and second pulse generators 18 and 81 which function in the same manner as those used in the second embodiment. The first and second sensors $S_3$, $S_4$ are provided in this embodiment, too.

Figure 13:
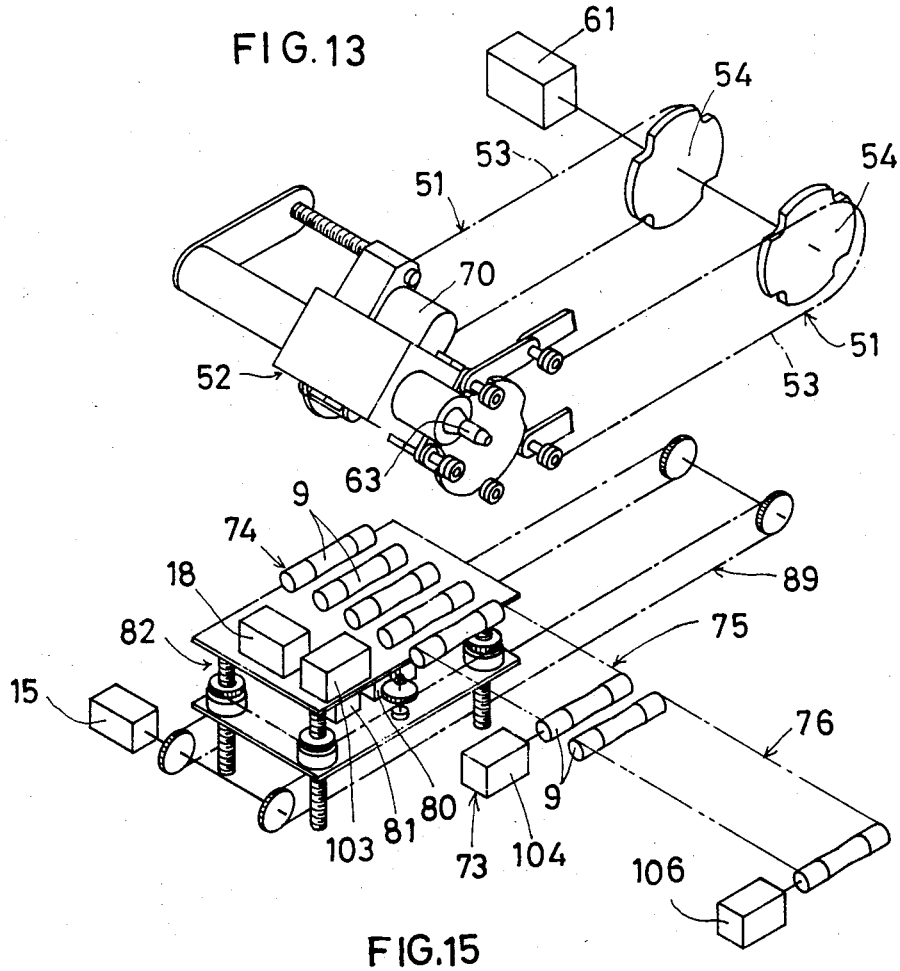
FIG. 13 is a perspective view thereof.

In this embodiment, the same lateral and vertical displacement units as in the second embodiment are used, as shown in FIG. 13.

In this embodiment, too, a discharge detector 79 is used as in the third embodiment. Also, a discharge complete detector 134 is provided to detect that the web roll has been laid on the fourth conveyor 78.

Figure 14:
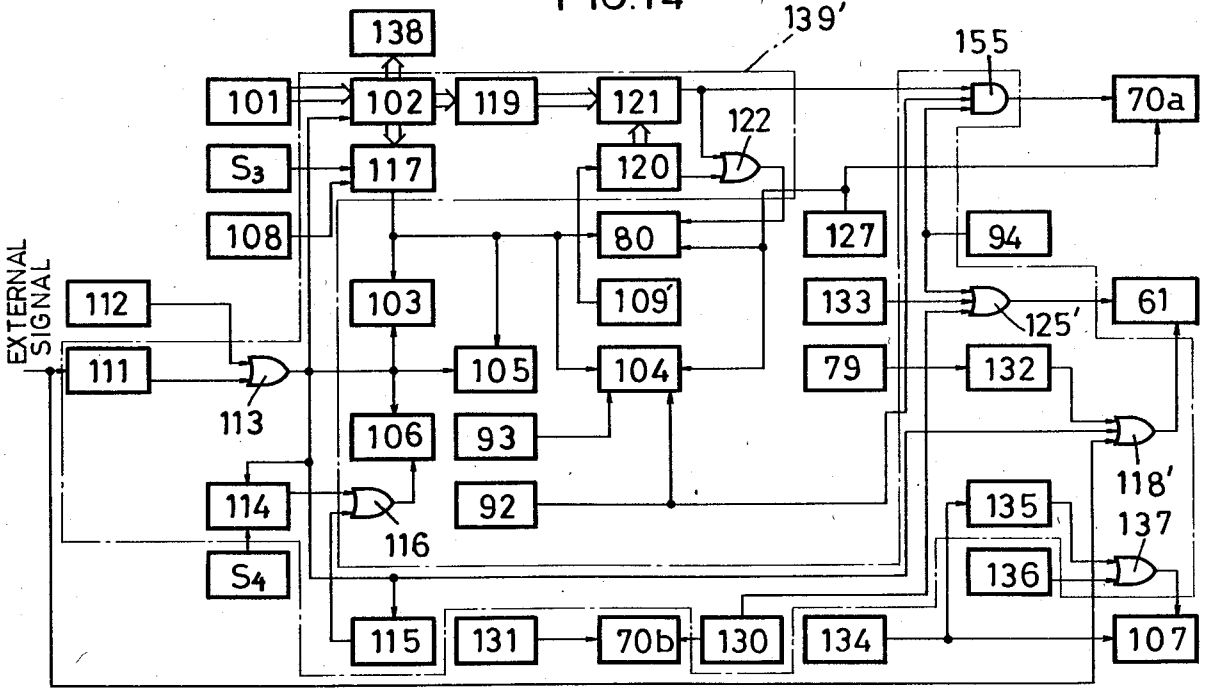
FIG. 14 is a block diagram of a control circuit used in the fourth embodiment.

In FIG. 14 showing a block diagram of the control circuit used in the fourth embodiment, the diameter, 2R, and width, 2W, of the roll A are set in a setter 101, which gives them a memory 102 of a control unit 139'. The memory can register a plurality of set values which can be changed by operating the setter 101.

A timer circuit 111 receives an external signal indicating that the supply of web from the web roll supported on the roll supports 52 has completed, e.g. a splicing complete signal from the splicer, and, gives a signal a predetermined time after the receipt.

An OR circuit 113 gives an OR signal when it receives at least one of the signal from the timer circuit 111 and the signal from a supply start switch 112. In response to the OR signal, the first, second and third roller drives 103, 104 and 106 are driven.

A counter 114 is reset by the OR signal and gives a signal each time it receives the second detection signal from the second sensor $S_4$. A timer circuit 115 gives a signal after a predetermined time after it has received the OR signal. When an OR circuit 116 receives a signal from the counter 114 or the signal from the timer circuit 115, it stops the third roller drive 106.

In response to the detection signal from the first sensor $S_3$, a counter 117 reads the value W (half of the roll width) from the memory 102 and starts counting of the pulses from the first pulse generator 108. When the count has become equal to the value W, the counter gives a signal to stop the first and second roller drives 103 and 104.

A computing unit 119 receives the diameter, 2R, of the roll A from the memory 102 and performs computation expressed by the equation (8) to obtain the distance y of vertical movement.

A reversible counter 120 counts the pulse signal from the second pulse generator 109'. Its count is proportional to the position of the first conveyor 74 with respect to the reference point (e.g. point where the lowermost part at the center of the rollers 9 is at the same level as the floor surface). When the count has become equal to the value y obtained in the computing unit 119, a comparator 121 gives a comparison signal.

The reversible counter 120 gives a reference signal when its count is zero, that is, when the first conveyor 74 is at its reference point. Upon receipt of the reference signal or the comparison signal from the comparator 121, an OR circuit 122 stops the vertical drive 80 which has been started in response to the signal from the counter 117.

In response to the signal from the counter 117, the lateral drive 104 is actuated to move the first conveyor 74 from its starting point toward the roll supports 52 and stopped by the signal from an end point detector 92.

When an AND circuit 155 receives all of the signal from the comparator 121, the signal from the end point detector 92 and the signal from the support position detector 94, it actuates the reversible motor 70a to bring the support shafts 63 toward each other to support the roll A. A signal from a support detector 127 for detecting that the roll A has been completely supported between the support shafts 63 will stop the reversible motor 70a.

The signal from the suppport detector 127 actuates the lateral drive 104 and the vertical drive 80 so that the first conveyor will go back to its starting point at the reference height. Then, in order to prevent the web roll from being rubbed by the upper surface of the first conveyor, the first conveyor should preferably be firstly lowered for some distance by the vertical drive 80 and be then moved toward the start point by the lateral drive 104.

Although the roll supports 52 are now at the position for roll support, they may be moved to a standby position for web supply by driving the motor 61 for the conveyor 51 after the support detector 127 has given a signal. In this case, the motor 61 may be stopped by a signal from a standby position detector (not shown).

The splice complete signal as an external signal actuates the motor 61 for the conveyor 51 through an OR circuit 118'. The motor is stopped in response to a signal given through an OR circuit 125' from a discharge detector 79 which detects the partially used web roll.

A predetermined time after the receipt of the signal from the discharge detector 79, a timer circuit 130 gives a timer signal to actuate the reversible motor 70b for the roll supports 52 at the discharge side so that the support shafts 63 will move away from each other out of the center hole in the web roll. The reversible motor 70b may be adapted to be directly actuated in response to the signal from the discharge detector 79, not through the timer circuit 130. The reversible motor 70b is stopped in response to the signal from an open detector 131 which detects the support shafts 63 at their fully open position.

The motor 61 for the conveyor 51 is actuated in response to a signal from a signal detector 132 which detects the fall of the signal from the discharge detector 79, and is stopped by a signal given from a roll support detector 133 through the OR circuit 125'.

When the released roll is put on the fourth conveyor 78, it is detected by a discharge complete detector 134 provided on the conveyor. The fourth roller drive 107 is actuated in response to a signal from the detector 134 and is stopped when an OR circuit 137 receives a signal from a timer circuit 135 or a signal from the discharged roll detector 136.

Next, the overall operation of the fourth embodiment will be described.

Firstly, when a predetermined length of the web has been supplied to the corrugator from the web roll supported on the roll supports 52 and a splice complete signal is given, the motor 61 for the conveyor 51 is driven. When the partially used web roll moves and is detected by the discharge detector 79, the signal from the detector stops the motor 61 and actuates the reversible motor 70b for the roll supports 52 so as to move the support shafts 63 away from each other.

Upon the fall of the signal from the discharge detector 79 detecting the web roll that has been released from the support shafts 63, the motor 61 is restarted to drive the conveyor 51 until the roll supports 52 are detected by the roll support detector 133 (usually located just under the sprockets 54 at the discharge side). When the web roll is discharged out of the roll supports 52 and detected by the discharge complete detector 134, the fourth conveyor 78 is driven to carry away the web roll. It is stopped either by signal from the discharged roll detector 136 or from a timer circuit 135 connected to the discharge complete detector 134.

A predetermined time after the giving of the splice complete signal, the timer circuit 111 gives a signal to the OR circuit 113. In response to the signal from the OR circuit, the first, second and third conveyors 74, 75 and 76 are driven so that the web roll will be carried about to the center of the first conveyor 74.

Then, the lateral drive 104 and the vertical drive 80 are actuated to move the first conveyor from its start point to the predetermined position for a distance x in a lateral direction and for a distance y in a vertical direction. On the other hand, the motor 61 for the conveyor 51 is actuated by the signal from the OR circuit 113 to move the roll supports 52 until they are detected by a support position detector 94. Now, the support shafts 63 are aligned with the center hole of the web roll.

The reversible motor 70a is actuated to move the support shafts toward each other to support the web roll. When it has been supported on the support shafts, this will be detected by the support detector 127. The signal therefrom actuates the lateral and vertical drives 104, 80 to move the first conveyor back to the start point at the reference height. The roll supports 52 are either kept at the position or moved to a standby position.

By repeating the above-mentioned steps, a plurality of web rolls can be supported on and released from the mill roll stand one after another automatically and continuously.

The supply start switch 112 is provided to start operation in case of emergency or if no web roll is supported on the roll supports 52.

In the fourth embodiment, it is preferable that the OR circuit 113 is adapted to give a signal only when the first conveyor is located at its start point and at the reference height to ensure that the web roll is put on the first conveyor.

In any of the embodiments, the distance L of lateral movement and the angle $\beta$ may not necessarily calculated in the computing unit 119, but may be obtained by use of equations or tables prepared beforehand.

The detectors and sensors used in the preferred embodiments may be replaced with any other means so long as they perform the same function.

The control and detection signals may be adapted to be given at any other point of time than in the preferred embodiments, so long as such a change is made within the scope of the present invention.

In any of the preferred embodiments, the diameter 2R and width 2W of the web roll may be measured automatically. Its width is measurable, e.g. by generating pulses by a pulse generator according to the amount of revolution of the rollers on the second conveyor and counting the pulses while the web roll is detected by a roll sensor.

Figure 15:
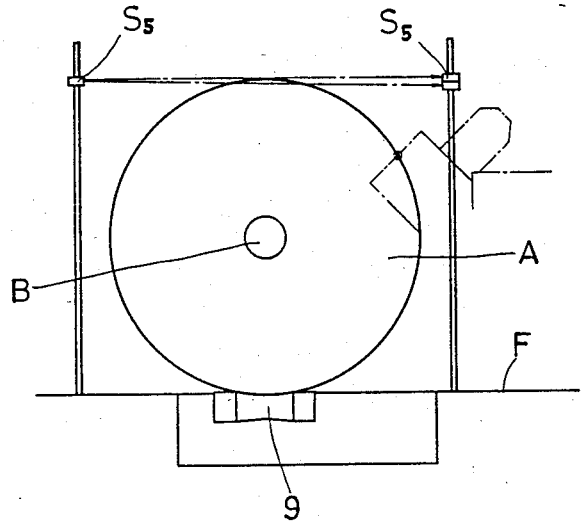
FIG. 15 is a view showing how the diameter of the web roll is determined.

Also, the diameter of the web roll can be measured by providing a pair of photosensors $S_5$ vertically movable (FIG. 15) and measuring the distance for which the photosensor has moved from the floor F. Instead of the photosensors, a vertically movable plate may be used. The diameter of the roll can be determined from the distance for which the plate has moved to abut the web roll. It may also be directly measured by means of an image sensor.

It will be understood from the foregoing that the present invention can save the time and labor required for the mounting and dismounting of the web roll on and from the mill roll stand. It can also ensure a secure support of the web roll and lessen the possibility of accidents to the operator.

What are claimed are:

1. An apparatus for automatically mounting a roll of web material on a mill roll stand having at least one pair of roll supports, said apparatus comprising:

a first driving means for moving said roll supports toward and away from each other;

a second driving means for moving said roll supports in a vertical direction;

a third driving means for moving the web roll in a direction parallel to the axis of said roll supports;

a fourth driving means for moving the web roll in a direction transverse to the axis of said roll supports;

a first pulse generator for generating a signal which is proportional to the amount of rotation of said second driving means;

a second pulse generator for generating a signal which is proportional to the amount of rotation of said third driving means;

a third pulse generator for generating a signal which is proportional to the amount of rotation of said fourth driving means; and a control means for providing signals to said first, second, third, and fourth driving means so as to control said third driving means on the basis of a comparison of the signal from said second pulse generator with the width of the web roll, and so as to move the web roll to a position halfway between but sideways of said roll supports, and so as to control said fourth driving means on the basis of a comparison of the signal from said third pulse generator with the diameter of the web roll, and so as to move the web roll to a position midway between said roll supports, and so as to control said second driving means on the basis of a comparison of the signal from said first pulse generator with the diameter of the web roll so as to move said roll supports in a vertical direction, and so that the axis of said roll supports will be in alignment with the center hole in the web roll, and so as to control said first driving means so as to move said roll supports toward each other until they are inserted into a center hole of the web roll, wherein the web roll is supported by said roll supports.

* * * * *